US010186249B1

(12) United States Patent
Lan

(10) Patent No.: US 10,186,249 B1
(45) Date of Patent: Jan. 22, 2019

(54) ACTIVE NOISE CANCELLATION SYSTEM

(71) Applicant: C-MEDIA ELECTRONICS INC., Taipei (TW)

(72) Inventor: Po-Shu Lan, New Taipei (TW)

(73) Assignee: C-MEDIA ELECTRONICS INC., Taipei (TW)

( * ) Notice: Subject to any disclaimer, the term of this patent is extended or adjusted under 35 U.S.C. 154(b) by 0 days.

(21) Appl. No.: 15/811,582

(22) Filed: Nov. 13, 2017

(30) Foreign Application Priority Data

Jul. 24, 2017 (TW) ..... 106124736 A

(51) Int. Cl.
*G10K 11/16* (2006.01)
*H04R 3/00* (2006.01)
*G10K 11/178* (2006.01)

(52) U.S. Cl.
CPC .... *G10K 11/178* (2013.01); *G10K 2210/3028* (2013.01)

(58) Field of Classification Search
CPC ..... H04R 1/1083; H04R 3/00; H04R 3/005; H04R 2460/01; G10K 11/178; G10K 11/17823; G10K 11/17825; G10K 11/17879; G10K 2210/02; G10K 2210/3023; G10K 2210/3028; G10K 2210/505; G10K 2210/1081; G10L 21/02; G10L 21/0208
See application file for complete search history.

(56) References Cited

U.S. PATENT DOCUMENTS 8,340,323 B2 * 12/2012 Asada ..... H04R 1/1041 381/103
9,236,041 B2 * 1/2016 Asada ..... G10K 11/1782
2006/0224382 A1 * 10/2006 Taneda ..... G10L 15/25 704/233
2008/0159555 A1 * 7/2008 Asada ..... G10K 11/178 381/71.11
2008/0212791 A1 * 9/2008 Asada ..... G10K 11/178 381/71.6
2012/0308022 A1 * 12/2012 Ookuri ..... G10K 11/178 381/71.1
2018/0115818 A1 * 4/2018 Asada ..... H04R 1/1091

* cited by examiner

*Primary Examiner* — Thang V Tran
(74) *Attorney, Agent, or Firm* — Li & Cai Intellectual Property (USA) Office

(57) ABSTRACT

An active noise cancellation system for canceling noises within a predetermined bandwidth includes an analog-to-digital converter, a programmable noise-cancellation module, a first interpolation filter and a digital-to-analog converter. The analog-to-digital converter receives a first audio signal, and converts the first audio signal from an analog signal to a digital signal. The programmable noise-cancellation processes the first audio signal to generate a noise cancellation signal. The first interpolation filter receives a second audio signal and filters the second audio signal. The noise cancellation signal and the filtered second audio signal are integrated by an adder as a third audio signal, and then the digital-to-analog converter converts the third audio signal from a digital signal to an analog signal.

16 Claims, 3 Drawing Sheets

ACTIVE NOISE CANCELLATION SYSTEM

BACKGROUND OF THE INVENTION

1. Field of the Invention

The present disclosure relates to an active noise cancellation system, and more particularly to an active noise cancellation system having less transmission latency.

2. Description of Related Art

The active noise cancellation system is mainly for reducing background noises. For example, the active noise cancellation system can be used in a headphone to provide a compensation signal for reducing background noises. Without the active noise cancellation system, a user hears both of the music played by the headphone and the background noises. The compensation signal provided by the active noise cancellation system and the background noises are mutually interfered, so the user hears less background noises or barely hears the background noises.

However, the performance of the active noise cancellation system is restricted by its transmission latency. Generating a compensation signal needs time, and thus causes the transmission latency. The transmission latency affects the performance of the active noise cancellation system. The more the transmission latency is, the later the compensation signal is provided. If the compensation signal is provided too late, it will be not effective to cancel the background noises.

SUMMARY OF THE INVENTION

The present disclosure provides an active noise cancellation system for canceling noises within a predetermined bandwidth. The active noise cancellation system includes an analog-to-digital converter, a programmable noise-cancellation module, a first interpolation filter and a digital-to-analog converter. The analog-to-digital converter receives a first audio signal, and converts the first audio signal from an analog signal to a digital signal. The programmable noise-cancellation module is electrically connected to the analog-to-digital converter. The programmable noise-cancellation module processes the first audio signal to generate a noise cancellation signal. The first interpolation filter receives a second audio signal and filters the second audio signal. The digital-to-analog converter is electrically connected to the programmable noise-cancellation module and the first interpolation filter through an adder. The noise cancellation signal and the filtered second audio signal are integrated by the adder as a third audio signal, and then the digital-to-analog converter converts the third audio signal from a digital signal to an analog signal.

In one embodiment of the active noise cancellation system provided by the present disclosure, the analog-to-digital converter is a sigma-delta converter ($\Sigma\Delta$ converter). The $\Sigma\Delta$ converter converts the first audio signal from the analog signal to the digital signal by oversampling the first audio signal. Thereby, the background noises received by a microphone, which is an analog signal, can be converted to a digital signal. In addition, the active noise cancellation system further includes a modulator. The modulator is electrically connected between the adder and the digital-to-analog converter. The modulator is configured to modulate the third audio signal. The modulated third audio signal is converted to an audio signal from a digital signal to an analog signal by the digital-to-analog converter.

In one embodiment of the active noise cancellation system provided by the present disclosure, the programmable noise-cancellation module includes a programmable decimation circuit, a programmable filter circuit and a programmable interpolation circuit. The programmable decimation circuit is electrically connected to the analog-to-digital converter, the programmable filter circuit is electrically connected to the programmable decimation circuit, and the programmable interpolation circuit is electrically connected to the programmable filter circuit. The programmable decimation circuit decimates the converted first audio signal. Then, the programmable filter circuit filters the decimated first audio signal. After that, the programmable interpolation circuit interpolates the filtered first audio signal.

The active noise cancellation system provided by the present disclosure effectively reduces the transmission latency and increases the operation flexibility by oversampling signals and by using a programmable noise-cancellation module.

For further understanding of the present disclosure, reference is made to the following detailed description illustrating the embodiments of the present disclosure. The description is only for illustrating the present disclosure, not for limiting the scope of the claim.

BRIEF DESCRIPTION OF THE DRAWINGS

Embodiments are illustrated by way of example and not by way of limitation in the figures of the accompanying drawings, in which like references indicate similar elements and in which.

DETAILED DESCRIPTION OF EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings. In these drawings, like references indicate similar elements.

It will be understood that, although the terms first, second, third, and the like, may be used herein to describe various elements, these elements should not be limited by these terms. These terms are only to distinguish one element from another element, and the first element discussed below could be termed a second element without departing from the teachings of the instant disclosure. As used herein, the term "and/or" includes any and all combinations of one or more of the associated listed items.

There are several embodiments described as follows for illustrating but not for restricting the active noise cancellation system provided by the present disclosure.

Figure 1:
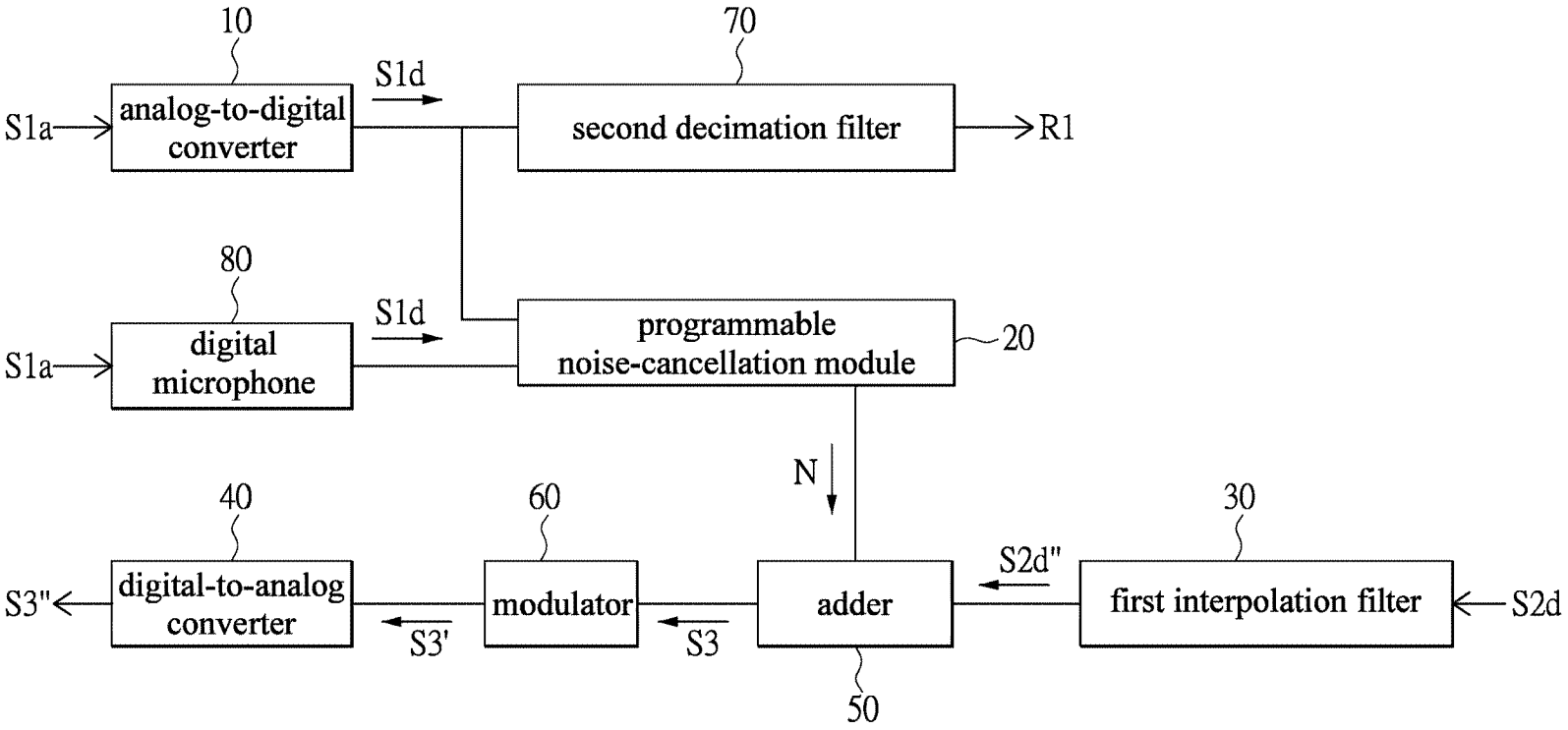
FIG. 1 shows a block diagram of an active noise cancellation system according to one embodiment of the present disclosure.

Referring to FIG. 1, a block diagram of an active noise cancellation system according to one embodiment of the present disclosure is shown.

As shown in FIG. 1, the active noise cancellation system includes an analog-to-digital converter 10, a programmable noise-cancellation module 20, a first interpolation filter 30 and a digital-to-analog converter 40. The programmable noise-cancellation module 20 is electrically connected to the analog-to-digital converter 10. Also, the digital-to-analog converter 40 is electrically connected to the programmable noise-cancellation module 20 and the first interpolation filter 30 through an adder 50.

The major working principle of the active noise cancellation system in this embodiment is that, according to a surrounding audio signal (or a background audio signal), a noise cancellation signal N is generated through the analog-to-digital converter 10 and the programmable noise-cancellation module 20. The noise cancellation signal N corresponds to the surrounding audio signal. For example, the noise cancellation signal N is an inverting signal of the surrounding audio signal. Then, the noise cancellation signal N and an audio signal to be played are integrated as an audio signal by the adder 50. As a result, when this integrated audio signal is played, the surrounding audio signal can be cancelled by the noise cancellation signal N. In this manner, when this integrated audio signal is played, less noise can be heard. It should be noted that, in this embodiment, the active noise cancellation system also can directly receive the surrounding audio signal by a digital microphone 80 (e.g. a MEMS MIC), and then generate the noise cancellation signal N by the programmable noise-cancellation module 20 according to the surrounding audio signal. However, it is not limited thereto.

Specifically speaking, the analog-to-digital converter 10 receives an analog first audio signal S1*a*, and then converts the analog first audio signal S1*a* to a digital first audio signal S1*d*. Herein, the analog first audio signal S1*a* is the above mentioned surrounding audio signal (or the background audio signal). It should be noted that, in this embodiment, the analog-to-digital converter 10 is a ΣΔ converter, and this ΣΔ converter converts the analog first audio signal S1*a* by oversampling. For example, the sample rate of the ΣΔ converter can be 64× or even 128×, but it is not limited thereto. After that, the programmable noise-cancellation module 20 processes the digital first audio signal S1*d* and then generates a noise cancellation signal N for cancelling the surrounding audio signal.

At the same time, the first interpolation filter 30 receives a second audio signal S2*d*, and then filters the second audio signal S2*d*. Herein, the second audio signal S2*d* is a digital audio signal to be played. Generally, this digital audio signal to be played is a PCM signal (Pulse-Code Modulation; PCM), but it is not limited thereto.

Finally, the noise cancellation signal N and the filtered second audio signal S2*d*" are integrated as a digital third audio signal S3 by the adder 50. Then, the digital-to-analog converter 40 coverts the digital third audio signal S3 to an analog third audio signal S3". Herein, the digital third audio signal S3 includes the digital audio signal to be played (i.e. the filtered second audio signal S2*d*") and the noise cancellation signal N.

It should be noted that, if the sample rate of the noise cancellation signal N differs from the sample rate of the filtered second audio signal S2*d*", the signal quality of the third audio signal S3, which is generated by integrating the filtered second audio signal S2*d*" and the noise cancellation signal N, will be bad. To avoid that, in this embodiment, the active noise cancellation system uses the programmable noise-cancellation module 20 to generate the noise cancellation signal N of which the sample rate is equal to the sample rate of the filtered second audio signal S2*d*".

Figure 2:
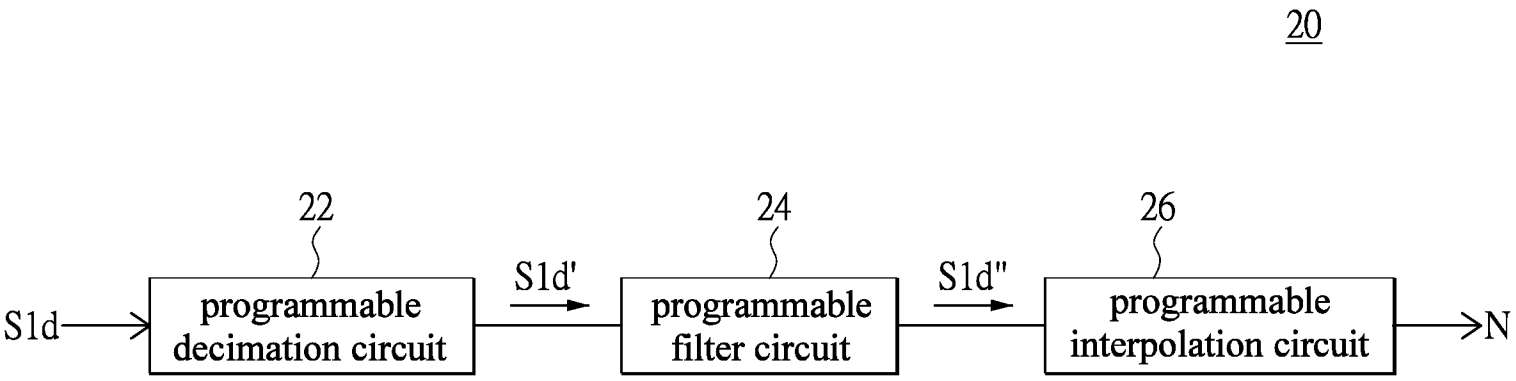
FIG. 2 shows a block diagram of a programmable noise-cancellation module of the active noise cancellation system according to one embodiment of the present disclosure.
Figure 3:
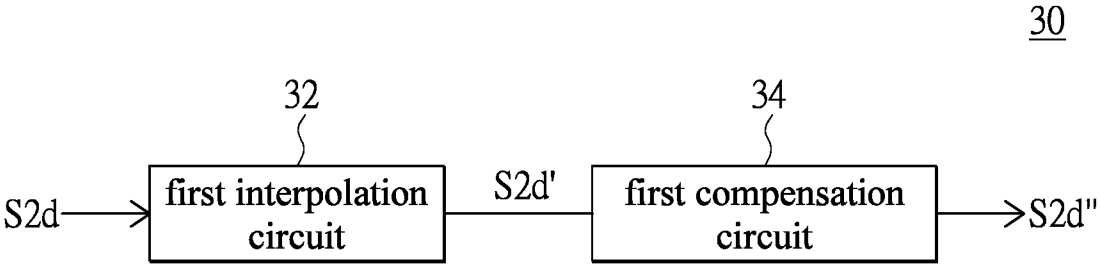
FIG. 3 shows a block diagram of a first interpolation filter of the active noise cancellation system according to one embodiment of the present disclosure.

Referring to FIG. 2 and FIG. 3, FIG. 2 shows a block diagram of a programmable noise-cancellation module of the active noise cancellation system according to one embodiment of the present disclosure, and FIG. 3 shows a block diagram of a first interpolation filter of the active noise cancellation system according to one embodiment of the present disclosure.

As shown in FIG. 2, the programmable noise-cancellation module 20 includes a programmable decimation circuit 22, a programmable filter circuit 24 and a programmable interpolation circuit 26. The programmable decimation circuit 22 is electrically connected to the analog-to-digital converter 10, the programmable filter circuit 24 is electrically connected to the programmable decimation circuit 22, and the programmable interpolation circuit 26 is electrically connected to the programmable filter circuit 24.

As shown in FIG. 3, the first interpolation filter 30 includes a first interpolation circuit 32 and a first compensation circuit 34, and the first compensation circuit 34 is electrically connected to the first interpolation circuit 32.

For ease of illustration, the sample rate of the analog-to-digital converter 10, the sample rate of the digital-to-analog converter 40, and the sample rate of the modulator 60 are, for example, 128×. In this case, the programmable decimation circuit 22 decimates the digital first audio signal Std. For example, after oversampling, the sample rate of the digital first audio signal S1*d* is 128× and the programmable decimation circuit 22 decimates the digital first audio signal S1*d* to make its sample rate 16× down, wherein the decimated first audio signal S1*d* is labeled as S1*d*' in FIG. 2. Then, the programmable filter circuit 24 filters the first audio signal S1*d*' of which the sample rate of the first audio signal S1*d*' is 8×, wherein the filtered first audio signal S1*d*' is labeled as S1*d*" in FIG. 2. After that, the programmable interpolation circuit 26 interpolates the first audio signal S1*d*" to make its sample rate 16× up, and the interpolated first audio signal S1*d*" is the noise cancellation signal N.

At the same time, when the first audio signal S1*d* is processed for generating the noise cancellation signal N, the first interpolation filter 30 processes the second audio signal S2*d*. First, the first interpolation circuit 32 interpolates the second audio signal S2*d*. For example, the second audio signal S2*d* may be a 48 KHz PCM signal or a 44.1 KHz PCM signal. The first interpolation circuit 32 interpolates the second audio signal S2*d* to make its sample rate 128× up, wherein the interpolated second audio signal S2*d* is labeled as S2*d*' in FIG. 3. The sample rate of the interpolated second audio signal S2*d* has been rapidly up to 128×, so the signal attenuation may occur. Considering that, the first compensation circuit 34 compensates the second audio signal S2*d*', to cover the signal attenuation. As shown in FIG. 3, the compensated second audio signal S2*d*' is labeled as S2*d*". In this embodiment, the first interpolation circuit 32 can be implemented by a CIC (Cascaded Integrator Comb; CIC) filter, a FIR (Finite Impulse Response; FIR) filter or an IIR filter (Infinite Impulse Response; IIR), and the first compensation circuit 34 can be implemented by a FIR filter. Preferably, the first interpolation circuit 32 should be implemented by a CIC filter. However, these examples are for illustrating but not for restricting the circuit configurations of the first interpolation circuit 32 and the first compensation circuit 34.

As s result, the sample rate of the noise cancellation signal N generated by the programmable noise-cancellation module 20 and the sample rate of the second audio signal S2*d*" are both 128×, so a third audio signal S3 can be properly generated by the adder 50. Finally, the modulator 60 modulates the third audio signal S3, and the modulated third audio signal S3' is converted to an analog third audio signal S3" by the digital-to-analog converter 40.

Figure 4:
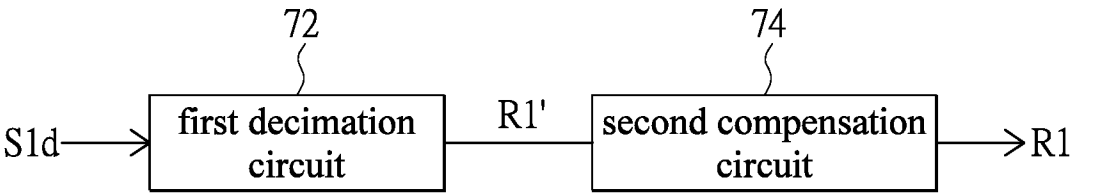
FIG. 4 shows a block diagram of a second decimation filter of the active noise cancellation system according to one embodiment of the present disclosure.

Moreover, the active noise cancellation system in this embodiment further includes a second decimation filter 70. Referring to FIG. 4, a block diagram of a second decimation filter of the active noise cancellation system according to one embodiment of the present disclosure is shown. As shown in FIG. 4, the second decimation filter 70 includes a first decimation circuit 72 and a second compensation circuit 74. The first decimation circuit 72 is electrically connected to the analog-to-digital converter 10, and the second compensation circuit 74 is electrically connected to the first decimation circuit 72. The second decimation filter 70 is configured to decimate and filter an oversampled signal and then to provide a digital audio signal for recording. To provide an audio recording signal R1, such as a 48 KHz PCM signal or a 44.1 KHz PCM signal, the first decimation circuit 72 decimates the first audio signal S1*d* of which the sample rate is 128×. When the sample rate of the first audio signal S1*d* is rapidly down to 1×, the signal attenuation may occur. Considering that, the second compensation circuit 74 compensates the decimated first audio signal R1', to cover the signal attenuation. In FIG. 4, the first audio signal R1' is labeled as R1 after being compensated. In this embodiment, the first decimation circuit 72 can be implemented by a CIC filter, and the second compensation circuit 74 can be implemented by a FIR filter. However, these examples are for illustrating but not for restricting the circuit configurations of the first decimation circuit 72 and the second compensation circuit 74.

In the following descriptions, how to make sure that the sample rate of the noise cancellation signal N generated by the programmable noise-cancellation module 20 is equal to the sample rate of the compensated second audio signal S2*d*" is illustrated.

In the above example, the analog-to-digital converter 10 converts the first audio signal S1*a* by 128× oversampling. According to this sample rate, the programmable decimation circuit 22 adjusts its decimation ratio such that the programmable filter circuit 24 can work within a sample rate range from 2× to 8×. In this embodiment, the programmable decimation circuit 22 can be implemented by a CIC filter and the decimation ratio of the CIC filter is programmable, so that analog-to-digital converters having different oversampling rates can be used in the active noise cancellation system.

If the sample rate of the programmable filter circuit 24 is 1×, the total latency generated due to the decimation process of the programmable decimation circuit 22, the filtering process of the programmable filter circuit 24 and the interpolation process of the programmable interpolation circuit 26 will badly affect the performance of the active noise cancellation system. Therefore, making the programmable filter circuit 24 work within a sample rate range from 2× to 8× can reduce the transmission latency of the active noise cancellation system.

In one example, it is assumed that the recording sample rate is 48 KHz and the total latency generated due to the process of the programmable noise-cancellation module 20 is 14 samples. If the sample rate of the programmable noise-cancellation module 20 is 2×, the total latency will be 0.14583 ms (i.e. [1/(2*48 KHz)]*14). Therefore, in this example, as long as the frequency of the background noises are less than 6.857 KHz (i.e. 1/0.14583 KHz), the background noise can be cancelled effectively by the active noise cancellation system. This example shows that, making the programmable filter circuit 24 work within a sample rate range from 2× to 8× can reduce the transmission latency of the active noise cancellation system and effectively cancel the low-frequency background noises.

As mentioned, in this embodiment, the programmable filter circuit 24 is implemented by at least two IIR filters, and the conversion coefficients of the IIR filters are programmable. Thus, by adjusting the conversion coefficients of the IIR filters, the signal phase, the cut-off frequency and the type of the filters can be designed. For example, by adjusting the conversion coefficients of the IIR filters, the programmable filter circuit 24 can be designed as a Notch Filter and a Low Pass Filter, which helps to optimize the filtering efficiency of the programmable filter circuit 24.

In this embodiment, the sample rate of the digital-to-analog converter 40 and the sample rate of the sample rate of the modulator 60 are both 128×, so the programmable interpolation circuit 26 adjusts its interpolation ratio according these sample rates to interpolate the first audio signal S1*d*" and then generate the noise cancellation signal N. As mentioned, the sample rate of the filtered first audio signal S1*d*" is 8×, so the programmable interpolation circuit 26 interpolates the filtered first audio signal S1*d*" for making its sample rate up to 128×. In this manner, by adjusting the decimation ratio of the programmable decimation circuit 22 and the interpolation ratio of the programmable interpolation circuit 26, the signal sampled under different oversampling rates can be processed by the system.

In a conventional analog noise cancellation circuit, to use an operation amplifier for filtering signals, there will be additional circuit elements needed, such as resistors, capacitors or the like. Theses extra circuit elements make the circuit area of the noise cancellation circuit increase. In addition, the performance of the noise cancellation circuit may be affected due to the manufacturing variance of the resistors and capacitors. On the other hand, in this embodiment, the programmable decimation circuit 22, the programmable filter circuit 24 and the programmable interpolation circuit 26 in the programmable interpolation circuit 20 are implemented by digital filters, so there is no additional circuit elements needed, such that the area of the system circuit will be smaller.

Since the conversion coefficients of the digital filters of the programmable decimation circuit 22, the programmable filter circuit 24 and the programmable interpolation circuit 26 are programmable, it can easily make sure that the sample rate of the noise cancellation signal N generated by the programmable noise-cancellation module 20 is equal to the sample rate of the filtered second audio signal S2*d*".

In another example, if the sample rate of the analog-to-digital converter 10 is 64× and the sample rate of the digital-to-analog converter 40 and the sample rate of the modulator 60 are 128×, the programmable decimation circuit 22 decimates the converted first audio signal S1*d* to make its sample rate 8× down. In FIG. 2, the decimated first audio signal is labeled as S1*d*'. Then, the programmable filter circuit 24 filters the decimated first audio signal S1*d*', wherein the sample rate of the decimated first audio signal S1*d*' is 8×. In FIG. 2, the filtered first audio signal is labeled as S1*d*". After that, the programmable interpolation circuit 26 interpolates the filtered first audio signal S1*d*" to make its sample rate 16× up to generate the noise cancellation signal of which the sample rate is 128×.

Since the conversion coefficients of the digital filters of the programmable decimation circuit 22, the programmable filter circuit 24 and the programmable interpolation circuit 26 are programmable, even though the sample rate of the analog-to-digital converter 10 is unequal to the sample rate of the digital-to-analog converter 40 and the sample rate of the modulator 60, it can still make sure that the sample rate of the noise cancellation signal N generated by the programmable noise-cancellation module 20 is equal to the sample rate of the compensated second audio signal S2*d″*.

It is worth mentioning that, in this embodiment, the programmable decimation circuit 22, the programmable filter circuit 24 and the programmable interpolation circuit 26 are implemented by low-latency filters. In addition, the frequency bandwidth of the background noises to be cancelled is usually less than 5 KHz. Thus, when the programmable noise-cancellation module 20 is processing signals, the signal compensation for the high-frequency band is unnecessary. Without the FIR filter configured for the signal compensation, the transmission latency and the hardware complexity of the active noise cancellation system can be both decreased. Specifically, the frequency bandwidth of the noises that the active noise cancellation system provided by this embodiment tends to cancel is under 2 KHz, and thus the above filter circuits having low transmission latency and less hardware complexity help the active noise cancellation system effectively cancel noises with less cost.

To sum up, the active noise cancellation system provided by the present disclosure is a digital active noise cancellation system. Compared with an analog active noise cancellation system, the digital active noise cancellation system provided by the present disclosure has a smaller circuit area because there are no additional passive elements. In addition, the active noise cancellation system provided by the present disclosure has other advantages as follows.

In the present disclosure, the programmable noise-cancellation module 20 is implemented by low-latency filters. Thus, there is no need to compensate for the frequency response when the programmable noise-cancellation module 20 works. Without the compensation process, the transmission latency of the active noise cancellation system can be effectively decreased.

Also, in the present disclosure, the conversion coefficients of the digital filters in the programmable noise-cancellation module are programmable, so that the decimation ratio and the interpolation ratio of the digital filters can be freely adjusted, which provides operation flexibility for the system. Based on the same reason, even though the analog-to-digital converter and the digital-to-analog converter may work at different oversampling rates, the active noise cancellation system can still have a great signal quality.

Moreover, the frequency bandwidth of the noises that a general active noise cancellation system circuit tends to cancel is roughly under 2 KHz. In the present disclosure, when the programmable noise-cancellation module works, signal attenuation will not occur under 5 KHz. Thus, even though there is no additional circuit configured for compensating the signal attenuation, the performance of the programmable noise-cancellation module will be still great.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An active noise cancellation system for canceling noises within a predetermined bandwidth, comprising:

an analog-to-digital converter, receiving a first audio signal, converting the first audio signal from an analog signal to a digital signal;

a programmable noise-cancellation module, electrically connected to the analog-to-digital converter, processing the first audio signal to generate a noise cancellation signal, and including:

a programmable decimation circuit, electrically connected to the analog-to-digital converter, decimating the converted first audio signal;

a programmable filter circuit, electrically connected to the programmable decimation circuit, filtering the decimated first audio signal; and a programmable interpolation circuit, electrically connected to the programmable filter circuit, interpolating the filtered first audio signal to generate the noise cancellation signal;

a first interpolation filter, receiving a second audio signal and filtering the second audio signal; and a digital-to-analog converter, electrically connected to the programmable noise-cancellation module and the first interpolation filter through an adder;

wherein the noise cancellation signal and the filtered second audio signal are integrated by the adder as a third audio signal, and the digital-to-analog converter converts the third audio signal from a digital signal to an analog signal.

2. The active noise cancellation system according to claim 1, wherein the sample rate of the noise cancellation signal is equal to the sample rate of the filtered second audio signal.

3. The active noise cancellation system according to claim 2, wherein the analog-to-digital converter converts the first audio signal from the analog signal to the digital signal by oversampling the first audio signal.

4. The active noise cancellation system according to claim 3, wherein the sample rate of the analog-to-digital converter is unequal to the sample rate of the digital-to-analog converter.

5. The active noise cancellation system according to claim 3, wherein the programmable decimation circuit decimates the converted first audio signal according to the sample rate of the analog-to-digital converter.

6. The active noise cancellation system according to claim 3, wherein the programmable interpolation circuit interpolates the filtered first audio signal according to the sample rate of the digital-to-analog converter.

7. The active noise cancellation system according to claim 3, wherein the programmable decimation circuit, the programmable filter circuit and the programmable interpolation circuit respectively include at least one low-latency filter.

8. The active noise cancellation system according to claim 7, wherein the programmable filter circuit includes at least two Infinite Impulse Response (IIR) filters, and conversion coefficients of the IIR filters are programmable.

9. The active noise cancellation system according to claim 8, wherein the IIR filters are a notch filter and a low-pass filter.

10. The active noise cancellation system according to claim 3, wherein the first interpolation filter includes:

a first interpolation circuit, interpolating the second audio signal according to the sample rate of the digital-to-analog converter; and a first compensation circuit, electrically connected to the first interpolation circuit, compensating the interpolated second audio signal.

11. The active noise cancellation system according to claim 10, wherein the first interpolation circuit is a Cascaded Integrator Comb (CIC) filter, and the first compensation circuit is a Finite Impulse Response (FIR) filter.

12. The active noise cancellation system according to claim 2, further comprising:

a modulator, electrically connected between the adder and the digital-to-analog converter, modulating the third audio signal;

wherein the modulated third audio signal is converted to an audio signal from a digital signal to an analog signal by the digital-to-analog converter.

13. The active noise cancellation system according to claim 2, further comprising:

a second decimation filter, electrically connected to the analog-to-digital converter, filtering the converted first audio signal.

14. The active noise cancellation system according to claim 13, wherein the second decimation filter includes:

a first decimation circuit, decimating the converted first audio signal; and a second compensation circuit, electrically connected to the first decimation circuit, compensating the decimated first audio signal.

15. The active noise cancellation system according to claim 1, wherein the predetermined bandwidth is 5 kHz.

16. An active noise cancellation system for canceling noises within a predetermined bandwidth, comprising:

an analog-to-digital converter, receiving a first audio signal, converting the first audio signal from an analog signal to a digital signal;

a programmable noise-cancellation module, electrically connected to the analog-to-digital converter, processing the first audio signal to generate a noise cancellation signal;

a first interpolation filter, receiving a second audio signal and filtering the second audio signal; and a digital-to-analog converter, electrically connected to the programmable noise-cancellation module and the first interpolation filter through an adder;

wherein the noise cancellation signal and the filtered second audio signal are integrated by the adder as a third audio signal, and the digital-to-analog converter converts the third audio signal from a digital signal to an analog signal;

wherein the sample rate of the noise cancellation signal is equal to the sample rate of the filtered second audio signal;

a second decimation filter, electrically connected to the analog-to-digital converter, filtering the converted first audio signal, and including:

a first decimation circuit, decimating the converted first audio signal; and a second compensation circuit, electrically connected to the first decimation circuit, compensating the decimated first audio signal.

* * * * *